US005662036A

United States Patent [19]

Daniel

[11] Patent Number: 5,662,036

[45] Date of Patent: Sep. 2, 1997

[54] COMPACTING APPARATUS

[75] Inventor: Douglas Daniel, Alberta, Canada

[73] Assignee: Compak Filter Services (Franchising) Inc., Lethbridge, Canada

[21] Appl. No.: 608,403

[22] Filed: Feb. 28, 1996

[51] Int. Cl.[6] ..... B30B 7/00

[52] U.S. Cl. ..... 100/209; 100/100; 100/249

[58] Field of Search ..... 100/185, 193, 100/209, 249, 100

[56] References Cited

U.S. PATENT DOCUMENTS

| | | | |
|---|---|---|---|
| 502,942 | 8/1893 | Witte | 100/209 |
| 877,193 | 1/1908 | Holden | 100/193 |
| 1,110,283 | 9/1914 | Beaston . | |
| 1,884,212 | 10/1932 | Power . | |
| 3,168,033 | 2/1965 | Hansen | 100/249 |
| 3,439,608 | 4/1969 | Huston, Sr. | 100/209 |
| 3,451,190 | 6/1969 | Tezuka . | |
| 3,548,890 | 12/1970 | Langen . | |
| 3,708,953 | 1/1973 | Aluotto . | |
| 3,980,014 | 9/1976 | McEwen et al. . | |
| 4,036,124 | 7/1977 | Seiler et al. | 100/209 |
| 4,108,063 | 8/1978 | Randolph . | |
| 4,235,165 | 11/1980 | Fenner et al. . | |
| 4,559,870 | 12/1985 | Krummacher et al. . | |
| 4,834,914 | 5/1989 | Jackson . | |
| 4,885,899 | 12/1989 | Hutchinson . | |
| 4,896,593 | 1/1990 | Slusser . | |
| 4,979,866 | 12/1990 | Croy | 100/100 |

FOREIGN PATENT DOCUMENTS

| | | | |
|---|---|---|---|
| 0125552 | 11/1984 | European Pat. Off. . | |
| 713880 | 11/1931 | France | 100/209 |
| 489410 | 6/1970 | Switzerland . | |
| 83/04192 | 12/1983 | WIPO . | |

*Primary Examiner*—Stephen F. Gerrity
*Attorney, Agent, or Firm*—Anthony R. Lambert

[57] ABSTRACT

A compacting apparatus includes a first elongate compaction chamber having a first end and a second end and a second elongate compaction chamber having a first end and a second end. The second compaction chamber is in parallel spaced relation with the first compaction chamber. A first compaction ram is in axial alignment with the first compaction chamber. The first ram is movable from a starting position at the first end telescopically into the first compaction chamber. A second compaction ram is in axial alignment with the second compaction chamber and movable from a starting position at the first end telescopically into the second compaction chamber. A gate is provided for closing the second end of the first compaction chamber. A gate is provided for closing the second end of the second compaction chamber. The first ram and the second ram move in opposite directions. When the first ram is moving toward the second end of the first compaction chamber in a compacting movement, the second ram is moving away from the second end of the second compaction chamber, and vice versa.

3 Claims, 4 Drawing Sheets

COMPACTING APPARATUS

FIELD OF THE INVENTION

The present invention relates to a compacting apparatus used for compacting waste materials.

BACKGROUND OF THE INVENTION

U.S. Pat. No. 3,708,953 which issued to Aluotto in 1973 illustrates a waste compaction apparatus, that is considered to be representative of the state of the art. The Aluotto reference discloses an elongate compaction chamber having a first end and a second end. Into the first end is placed material to be compacted. An hydraulic ram is axially aligned with and movable into and out of the elongate compaction chamber. The hydraulic ram enters the first end of the compaction chamber. As the hydraulic ram moves toward the second end of the compaction chamber, the waste material is compacted against an end gate at the second end. The end gate is then opened so that the compacted material can be readily removed from the compaction chamber. With the end gate open, the hydraulic ram is used to push the compacted material from the compaction chamber.

The compaction apparatus disclosed in the Aluotto reference is effective, but not particularly efficient in terms of daily production of compacted waste. It is the daily production of compacted waste that determines the commercial value of a compaction machine.

SUMMARY OF THE INVENTION

What is required is as more efficient configuration for a compacting apparatus.

According to the present invention there is provided a compacting apparatus which includes a first elongate compaction chamber having a first end and a second end and a second elongate compaction chamber having a first end and a second end. The second compaction chamber is in parallel spaced relation with the first compaction chamber. A first compaction ram is in axial alignment with the first compaction chamber. The first ram is movable from a starting position at the first end telescopically into the first compaction chamber. A second compaction ram is in axial alignment with the second compaction chamber and movable from a starting position at the first end telescopically into the second compaction chamber. Gate means is provided for closing the second end of the first compaction chamber. Gate means is provided for closing the second end of the second compaction chamber. The first ram and the second ram move in opposite directions. When the first ram is moving toward the second end of the first compaction chamber in a compacting movement, the second ram is moving away from the second end of the second compaction chamber, and vice versa.

With the compacting apparatus, as described above, when the first compaction chamber is compacting waste material; the second compaction chamber is being loaded. Personnel are continually kept occupied loading and unloading one of the two compaction chambers. This leads to a very efficient use of personnel.

Although beneficial results may be obtained through the use of the compacting apparatus, as described above, time can be lost by personnel latching and unlatching the gate means positioned at both the second end of the first compaction chamber and the second end of the second compaction chamber. Even more beneficial results may, therefore, be obtained when the second end of the second compaction chamber is on a common vertical plane with the second end of the first compaction chamber. The gate means for closing the second end of the first compaction chamber and the gate means for closing the second end of the second compaction chamber are a common movable gate member that moves along the common vertical plane. The movable gate member has a first port serving the first compaction chamber and a second port serving the second compaction chamber. The first port and the second port are both laterally and vertically spaced apart. When the first port is axially aligned with and allows access to the first compaction chamber, the second port is out of register with the second compaction chamber and the second compaction chamber is completely closed by the gate member. When the second port is axially aligned with and allows access to the second compaction chamber, the first port is out of register with the first compaction chamber and the first compaction chamber is completely closed by the gate member.

Although beneficial results may be obtained through the use of the compacting apparatus, as described above, the stroke of the first ram and the second ram is reduced if muzzle style loading is adopted, as compared to breach loading. Even more beneficial results may, therefore, be obtained when the waste material is loaded into the first compaction chamber through the first port, and into the second compaction chamber through the second port.

Although beneficial effects may be obtained through the use of the compacting apparatus, as described above, the waste compaction business is, for the most part, a mobile compaction service. The contractor brings his compacting equipment to the job site to compact the waste material. Once the waste material has been compacted it is removed by the contractor. It is, therefore, important that the compacting apparatus be readily movable to a job site. The logical way of doing this is by means of a truck or trailer. It has been determined that even more beneficial results may be obtained when the compacting apparatus is positioned transversely across a frame of a vehicle, whether it be a truck or a trailer. This maximizes the storage area left on the vehicle to receive compacted waste material.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
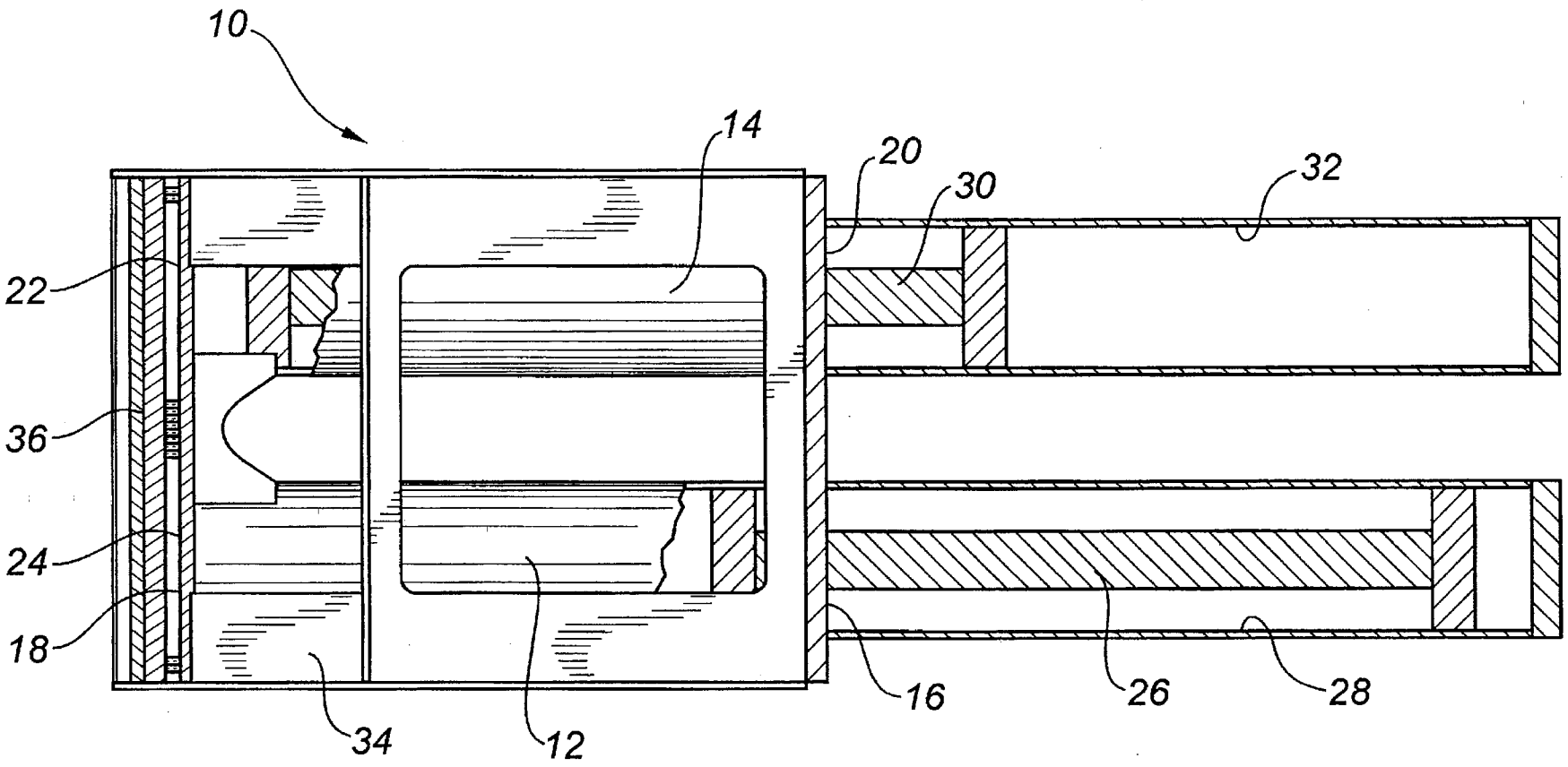
FIG. 1 is top plan view of a compacting apparatus constructed in accordance with the teachings of the present invention.

The preferred embodiment, a compacting apparatus generally identified by reference numeral 10, will now be described with reference to FIGS. 1 through 5.

Figure 2:
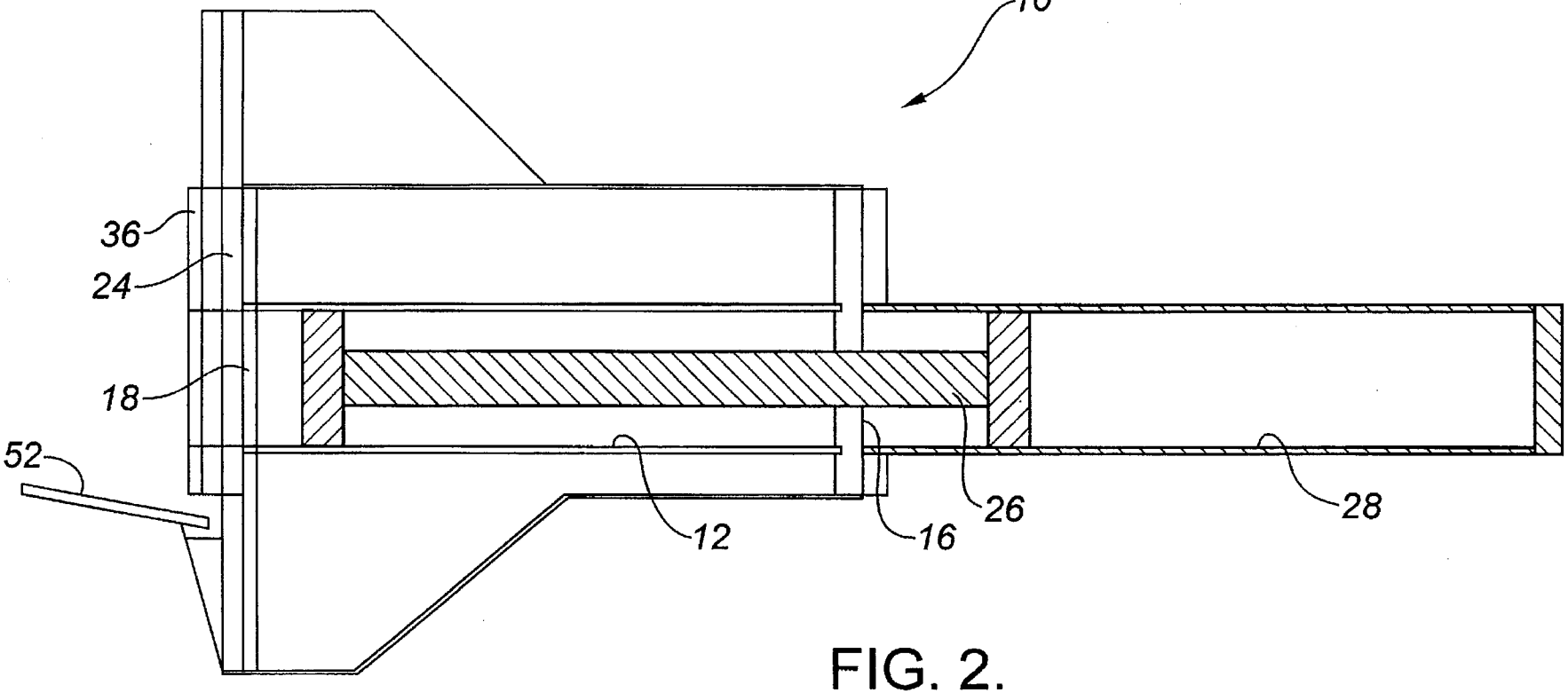
FIG. 2 is a side elevation view of the compacting apparatus illustrated in FIG. 1.
Figure 3:
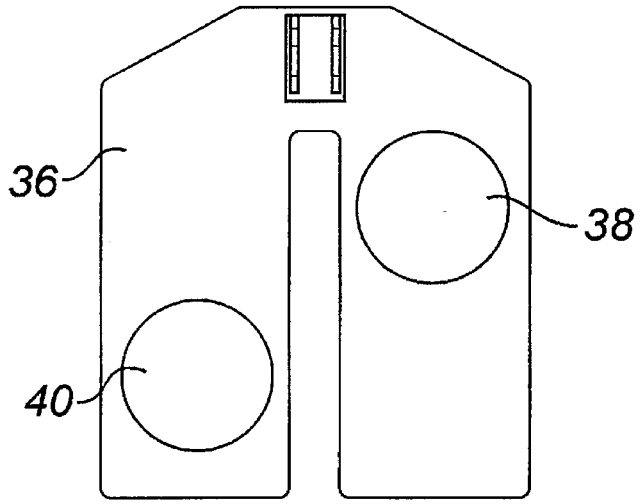
FIG. 3 is an end elevation view of the compacting apparatus illustrated in FIG. 1.
Figure 4:
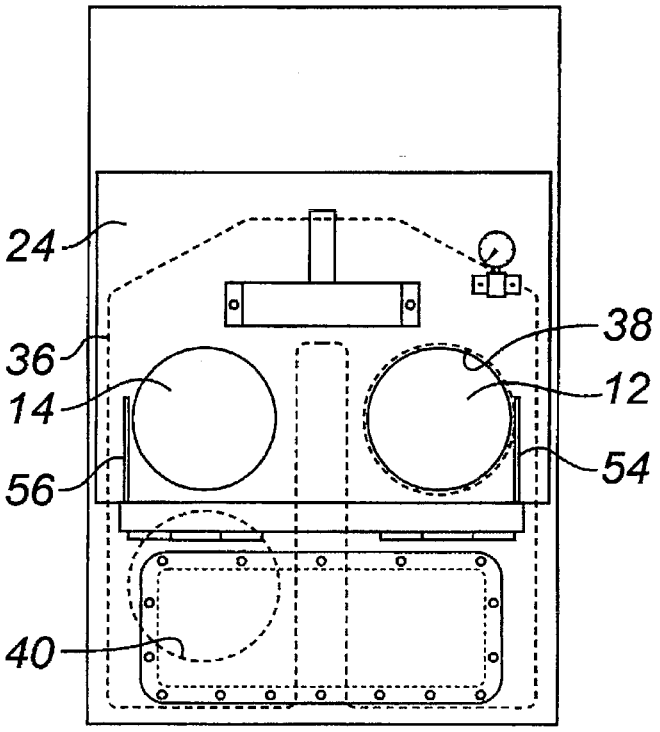
FIG. 4 is an end elevation view taken along section lines 4—4 of FIG. 1.
Figure 5:
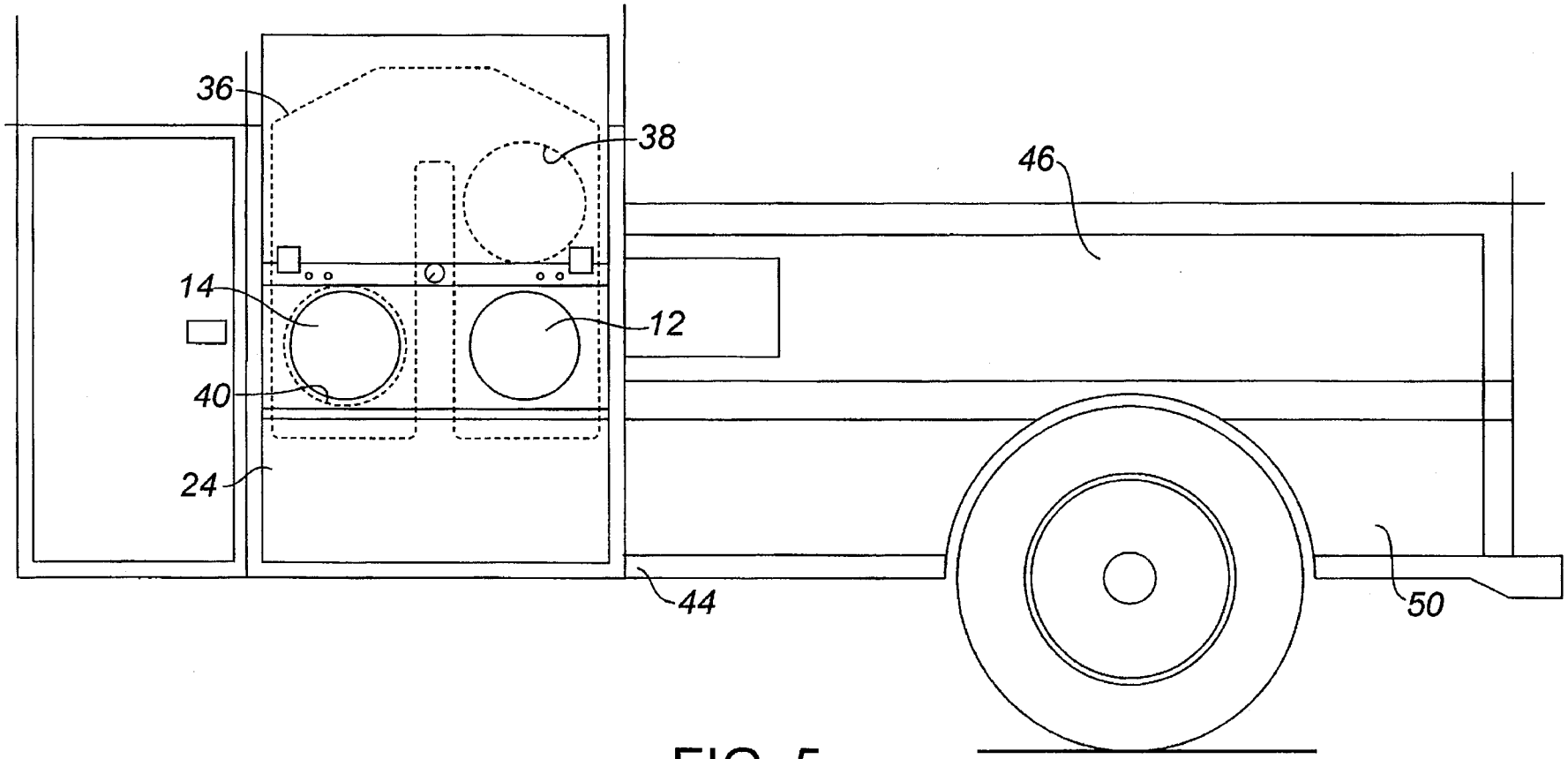
FIG. 5 is a end elevation view of the compacting apparatus illustrated in FIG. 4, mounted transversely on a vehicular frame.

Referring to FIG. 1, compacting apparatus 10 includes a first elongate compaction chamber 12 and a second elongate compaction chamber 14. First compaction chamber 12 has a first end 16 and a second end 18. Second compaction chamber 14 has a first end 20 and a second end 22. Second compaction chamber 14 is in parallel spaced relation with first compaction chamber 12. Second end 22 of second compaction chamber 14 is on a common vertical plane, defined by end plate 24, with second end 18 of first compaction chamber 12. A first compaction ram 26 is disposed in a first cylinder 28, which is in axial alignment with first compaction chamber 12. First ram 26 is movable from a starting position at first end 16, telescopically into first compaction chamber 12. A second compaction ram 30 is disposed in a second cylinder 32, which is in axial alignment with second compaction chamber 14. Second ram 30 is movable from a starting position at first end 20 telescopically into second compaction chamber 14. First compaction chamber 12 and second compaction chamber are covered by a common shroud 34. Second end 18 of first compaction chamber 12 and second end 22 of second compaction chamber 14 have a common movable gate member 36 that moves along the common vertical plane defined by end plate 24. Referring to FIG. 3, movable gate member 36 has a first port 38 serving first compaction chamber 12 and a second port 40 serving second compaction chamber 14. Referring to FIGS. 3 and 4, waste material is loaded into first compaction chamber 12 through first port 38, and into second compaction chamber 14 through second port 40. First port 38 and second port 40 are both laterally and vertically spaced apart. Referring to FIG. 4, when first port 38 is axially aligned with and allows access to first compaction chamber 12, second port 40 is out of register with second compaction chamber 14 and second compaction chamber 14 is completely closed by gate member 36. Referring to FIG. 5, when second port 40 is axially aligned with and allows access to second compaction chamber 14, first port 38 is out of register with first compaction chamber 12 and first compaction chamber 12 is completely closed by gate member 36. Referring to FIG. 1, first ram 26 and second ram 30 move in opposite directions. When first ram 26 is moving toward gate member 36 in a compacting movement, second ram 30 is moving away from gate member 36 and vice versa. Referring to FIG. 2, a seal 42 is provided where each of cylinders 28 housing first ram 26 and cylinder 32 housing second ram 30, connect to first end 16 of first compaction chamber 12 and first end 20 of second compaction chamber 14, respectively. Referring to FIG. 5, compacting apparatus is intended for mounting on a frame 44 of a vehicle 46. It is preferred that compacting apparatus 10 be positioned transversely across frame 44 of vehicle 46. This unique transverse positioning allows more room for on vehicle 46 to be used for storage of compacted waste.

The use and operation of compacting apparatus 10 will now be described with reference to FIGS. 1 through 5. Referring to FIG. 5, compacting apparatus 10 is transported to a remote work site by vehicle 46. Referring to FIGS. 3, 4 and 5, movable gate member 36 is moved first into a position in which first port 38 is axially aligned with and allows access for loading purposes to first compaction chamber 12, and then into a position in which second port 40 is axially aligned with and allows access for loading purposes to second compaction chamber 14. Referring to FIG. 1, first ram 26 and second ram 30 move in opposite directions. When first ram 26 is moving toward gate member 36 in a compacting movement, second ram 30 is moving away from gate member 36 and vice versa. The movement of gate member 36 is coordinated with the movement of rams 26 and 30. Referring to FIG. 4, when first port 38 is axially aligned with first compaction chamber 12 to permit loading, second compaction chamber 14 is completely closed by gate member 36 and ram 30 moves toward gate member 36 to compact waste material in second compaction chamber 14. Referring to FIG. 5, when second port 40 is axially aligned with second compaction chamber 14 to permit loading, first compaction chamber 12 is completely closed by gate member 36 and ram 26 moves toward gate member 36 to compact waste material in first compaction chamber 12. When all waste materials have been compacted, the compacted materials are loaded onto vehicle 46 and hauled away. It will be appreciated that the forces used for compaction are in the area of 150 tons. It would be highly undesirable to have both rams exerting a force upon gate member 36 at the same time, as the combined force would be 300 tons.

The prevention of any oil contamination to the environment is of paramount concern. It is, therefore, preferred that a number of features be included to minimize the risk of such environmental damage occurring. Referring to FIG. 5, it is preferred that an oil reservoir 50 be positioned transversely across frame 44 of vehicle 46 underlying compacting apparatus 10. Any oil that is squeezed out during the compaction process is caught in underlying oil reservoir 50. Referring to FIG. 2, it is preferred that an angled catch tray 52 be provided underlying gate member 36. The purpose of catch tray 52 is to catch any oil that drips down during loading and unloading through gate member 36 and direct such oil down angled catch tray 52 into oil reservoir 50. Referring to FIG. 4, it is preferred that a pair of paralled vertical grooves 54 and 56 be cut into end plate 24 on remote sides of the compaction chambers 12 and 14. Groove 54 is spaced from first compaction chamber 12. Groove 56 is spaced from second compaction chamber 14. The purpose of grooves 54 and 56 is to prevent oil from migrating along end plate 24 to a position where leaks may occur. The migrating oil is captured in grooves 54 and 56, and directed along said grooves into catch tray 52 and then into oil reservoir 50.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A compacting apparatus, comprising:

a first elongate compaction chamber having a first end and a second end;

a second elongate compaction chamber having a first end and a second end, the second compaction chamber being in parallel spaced relation with the first compaction chamber;

a first compaction ram in axial alignment with the first compaction chamber and movable from a starting position at the first end telescopically into the first compaction chamber;

a second compaction ram in axial alignment with the second compaction chamber and movable from a starting position at the first end telescopically into the second compaction chamber;

means for closing the second end of the first compaction chamber;

means for closing the second end of the second compaction chamber;

the first ram and the second ram moving in opposite directions, such that when the first ram is moving toward the second end of the first compaction chamber in a compacting movement the second ram is moving away from the second end of the second compaction chamber, and vice versa; and the second end of the second compaction chamber is on a common vertical plane with the second end of the first compaction chamber, the means for closing the second end of the first compaction chamber and the means for closing the second end of the second compaction chamber being a common movable gate member that moves along the common vertical plane, the movable gate member having a first port serving the first compaction chamber and a second port serving the second compaction chamber, the first port and the second port being both laterally and vertically spaced apart, when the first port is axially aligned with and allows access to the first compaction chamber, the second port is out of register with the second compaction chamber and the second compaction chamber is completely closed by the gate member, when the second port is axially aligned with and allows access to the second compaction chamber, the first port is out of register with the first compaction chamber and the first compaction chamber is completely closed by the gate member.

2. The compacting apparatus as defined in claim 1, wherein waste material is loaded into the first compaction chamber through the first port, and into the second compaction chamber through the second port.

3. A compacting apparatus, comprising:

a first elongate compaction chamber having a first end and a second end;

a second elongate compaction chamber having a first end and a second end, the second compaction chamber being in parallel spaced relation with the first compaction chamber with the second end of the second compaction chamber on a common vertical plane with the second end of the first compaction chamber;

a first compaction ram in axial alignment with the first compaction chamber and movable from a starting position at the first end telescopically into the first compaction chamber;

a second compaction ram in axial alignment with the second compaction chamber and movable from a starting position at the first end telescopically into the second compaction chamber;

the second end of the first compaction chamber and the second end of the second compaction chamber having a common movable gate member that moves along the common vertical plane, the movable gate member having a first port serving the first compaction chamber and a second port serving the second compaction chamber, waste material being loaded into the first compaction chamber through the first port, and into the second compaction chamber through the second port, the first port and the second port being both laterally and vertically spaced apart, when the first port is axially aligned with and allows access to the first compaction chamber, the second port is out of register with the second compaction chamber and the second compaction chamber is completely closed by the gate member, when the second port is axially aligned with and allows access to the second compaction chamber, the first port is out of register with the first compaction chamber and the first compaction chamber is completely closed by the gate member;

the first ram and the second ram move in opposite directions, such that when the first ram is moving toward the gate member in a compacting movement the second ram is moving away from the gate member and vice versa.

* * * * *